US005350313A

United States Patent [19]

Woller

[11] Patent Number: 5,350,313

[45] Date of Patent: Sep. 27, 1994

[54] LATCHING MECHANISM FOR BLINDMATE ELECTRICAL CONNECTORS

[75] Inventor: Josef Woller, Griesheim, Fed. Rep. of Germany

[73] Assignee: The Whitaker Corporation, Wilmington, Del.

[21] Appl. No.: 23,541

[22] Filed: Feb. 26, 1993

[30] Foreign Application Priority Data

Feb. 27, 1992 [GB] United Kingdom ..... 9204155

[51] Int. Cl.[5] ..... H01R 4/50

[52] U.S. Cl. ..... 439/347; 439/157

[58] Field of Search ..... 439/342, 345, 346, 347, 439/372, 159, 157

[56] References Cited

U.S. PATENT DOCUMENTS 4,332,432 6/1982 Colleran ..... 439/347
4,586,771 5/1986 Kraemer et al. .
5,061,197 10/1991 Kuzuno et al. ..... 439/342

FOREIGN PATENT DOCUMENTS 373002 9/1988 Fed. Rep. of Germany ..... 439/347
3812097 10/1989 Fed. Rep. of Germany ..... 439/347
2424643 11/1979 France .

*Primary Examiner*—David L. Pirlot
*Attorney, Agent, or Firm*—Eric J. Groen

[57] ABSTRACT

An electrical connector assembly includes a first housing half having an opened end face formed by upstanding side walls where inner surfaces of the side walls have camming grooves formed on the inner surfaces thereof. The grooves emanate from the opened end face and one groove has a laterally extending slot portion in communication with an inclined slot portion whereas a second camming slot is comprised of an inclined slot portion only. The housing portion includes a camming slide which is slidable moveable within a slot portion of the housing portion. The camming slide includes side arms having camming spigots positioned thereon. The housing portion is insertable through the open end face and movement of the camming slide positions the spigots in the inclined portion of the slot and the spigot portion and the inclined slot portion whereby the connector halves are drawn together in mated relation.

12 Claims, 7 Drawing Sheets

LATCHING MECHANISM FOR BLINDMATE ELECTRICAL CONNECTORS

BACKGROUND OF THE INVENTION

Field of the Invention

The subject invention relates to an improved latching mechanism for blindmate electrical connectors, and more particularly, relates to a mechanism for improved latching and unlatching for such blindmate applications. It is known from DE 3604548 to provide a sliding cam mechanism on one connector half, where the camming slide includes camming slots which cooperate with camming members on the other connector housing. These connectors are mated in an axial direction such that the mating face of each connector is in a parallel and opposed relation with the mating electrical connector.

The connector half having the camming slide includes a peripheral shroud therearound, and the camming slide moves parallel to the shroud, and is moveable relative thereto. Once the two connector housings are presented for connection, with the connector fully within the shroud of the other connector, the camming slide is moved in a direction transverse to the mating direction and the cooperating camming members on the two mating connector housings move the two connector housings and their associated electrical contacts into electrical engagement with one another. Movement of the camming slide in an opposite direction disengages the two connector halves from each other.

While the above mentioned latching system provides a substantial improvement to connector latching and unlatching systems, some applications or connector requirements are such that there is not adequate space or visual ability to place the connector to be mated in alignment within the shroud which surrounds the other connector.

For example, if the connector including the shroud is mounted in an area with little space above the shroud, it may be impossible to have the clearance to lift the mating connector above the shroud to clear it. Even if there is clearance to fit above the shroud, it may be difficult to align the connectors, as it may be impossible to see into the shroud.

SUMMARY OF THE INVENTION

It is an object of the invention then to provide an electrical connector system to assist in the latching and unlatching of such connector systems, in applications where the available height above the mating connector is reduced.

It is a further object of the invention to provide an improved latching and unlatching system for mating connectors in positions where the mating connectors are in blindmate applications.

The objects of the invention have been accomplished by providing an electrical connector assembly comprising mating first and second connector housings where one of the housings includes first camming members and the other housing includes a camming slide moveable transversely to a mating axis, including camming members thereon which cooperate with corresponding camming members on the first housing. The camming slide is moveable to cause axial movement between the first and second housings along the mating axis. The assembly is characterized in that the first housing has at least one partially opened end wall and said first camming members are positioned on inner side surfaces of the first housing, and the second connector member is insertable through the partially opened end wall along an axis transverse to the mating axis and intermediate to the side walls.

In this manner, the second electrical connector can be inserted through the open end of the first connector along a lateral axis to axially align the first and second connectors whereupon the camming slide can be operated to fully connect the first and second connectors.

In another aspect of the invention, an electrical connector assembly is comprised of first and second connector housings wherein the first connector housing includes a peripheral shroud, and the second connector is receivable within the shroud. The connector assembly is characterized in that the shroud is comprised of side walls and an end wall leaving one end open. The side walls have inner surfaces with guide members thereon, and the second connector has complementary second guide members for cooperation with said first guide members. The second connector is insertable through the open end of the first connector under guiding influence of the first and second guide members. The second connector is laterally moveable across the mating face of said first connector housing to a position where said first and second connectors are axially aligned, whereupon the first and second connector housings can be moved into mating engagement.

By providing the first electrical connector with the open end, the first electrical connector can be mounted to a bulkhead wall or other such device where the open end faces outwardly. The second connector can be aligned with the first connector by the guide members on the outer surface of the second housing and the guide members on the inner surface of the first housing side walls, thereby eliminating blind mating of the first and second electrical connectors. Also by providing an open end to the first electrical connector, the height requirement for mating of the first and second electrical connector housings has been reduced by the height of the side walls.

DETAILED DESCRIPTION OF THE PREFERRED EMBODIMENT

Figure 1:
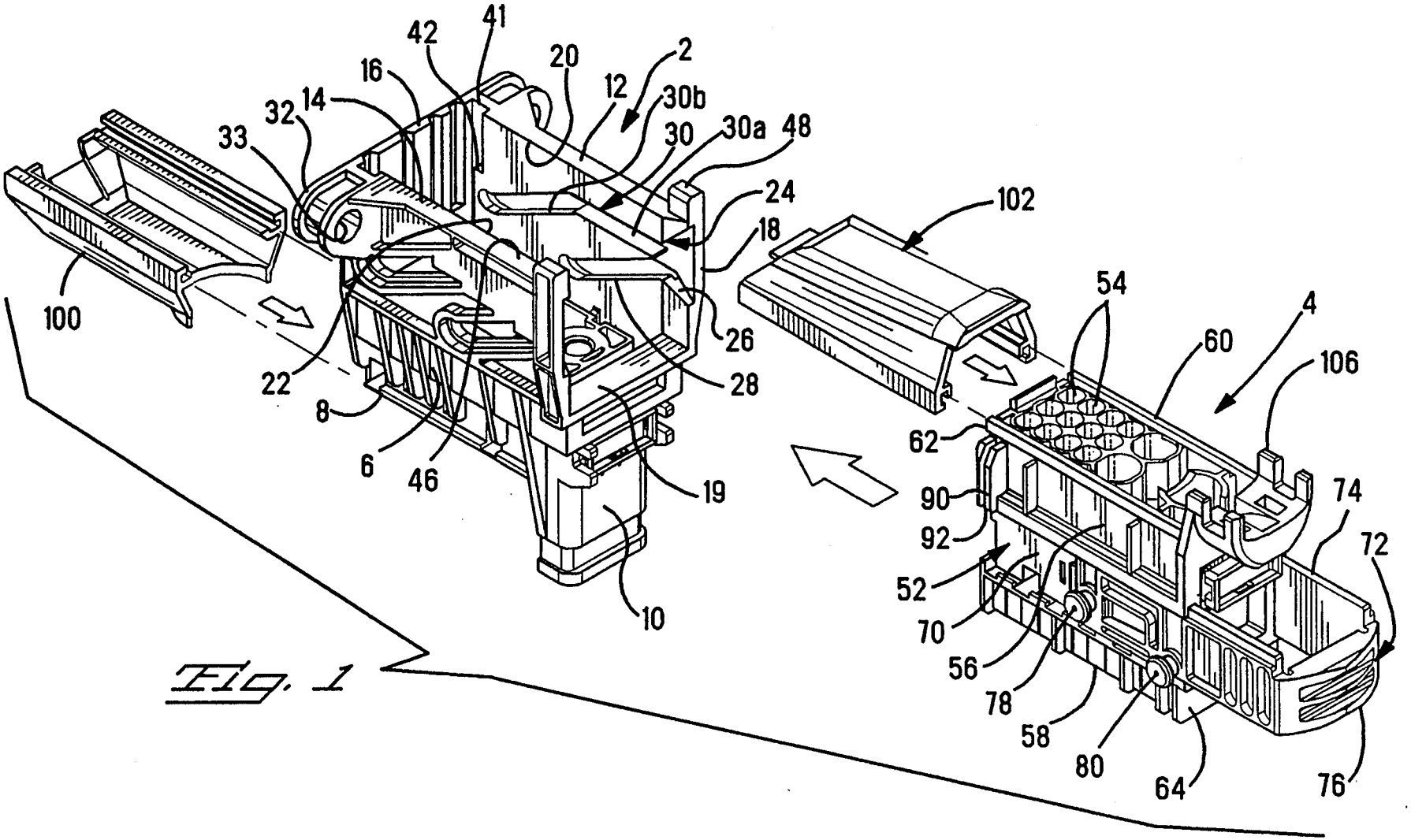
FIG. 1 is an isometric view showing the two connector halves poised in a mating relation.
Figure 3:
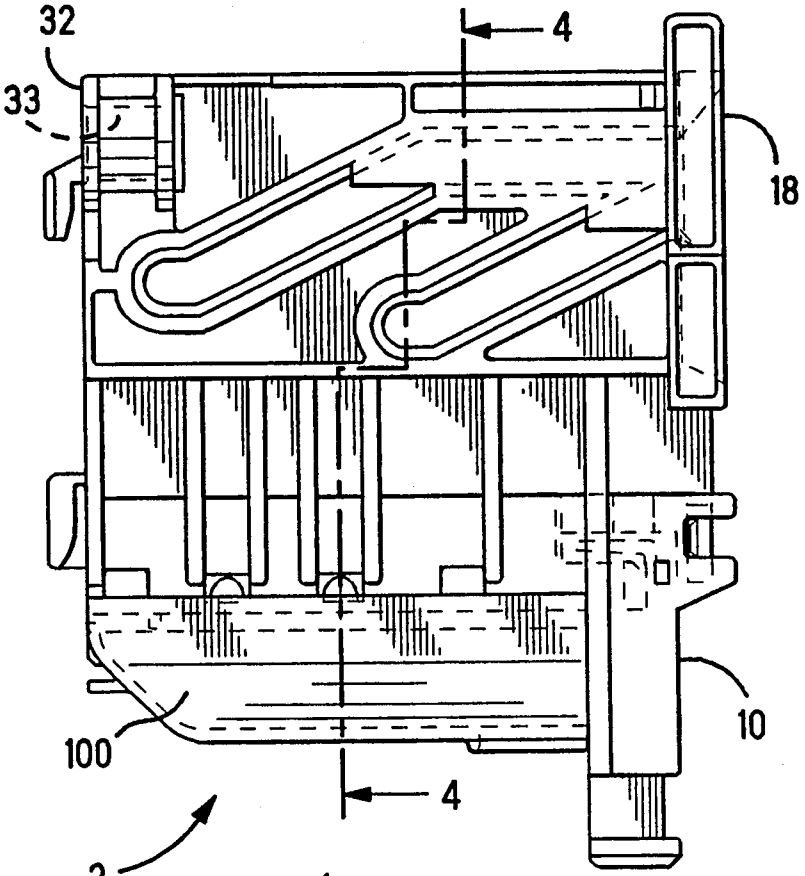
FIG. 3 is a side plan view of the connector of FIG. 2.
Figure 2:
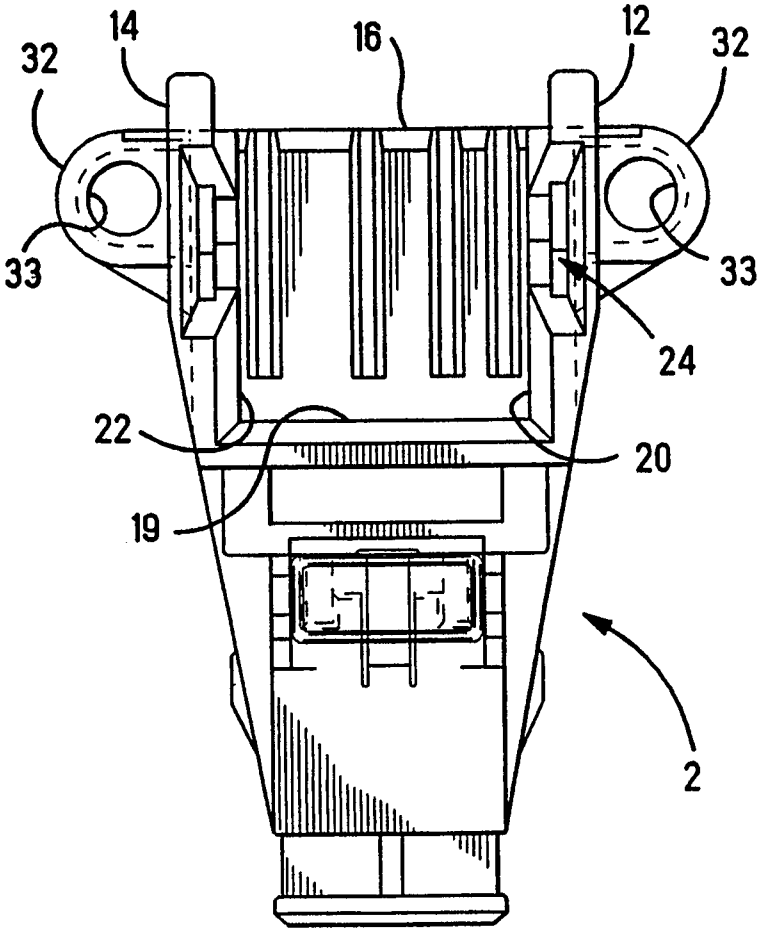
FIG. 2 is an end view of the connector to be mounted.
Figure 4:
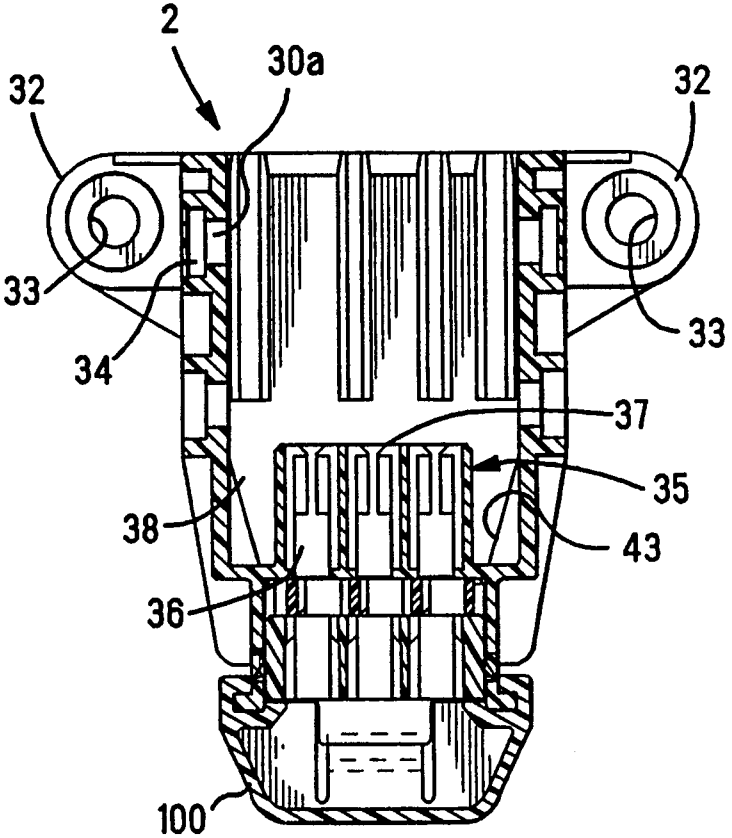
FIG. 4 is a cross-sectional view through lines 4—4 of FIG. 3.

With reference first to FIGS. 1 and 2, an electrical connector assembly is shown as including a receptacle housing 2 and a tab housing 4, where the tab housing 4 is electrically connectable with the receptacle housing 2. The receptacle housing 2 includes a central body portion 6 which would contain a plurality of receptacle terminals (not shown in FIG. 1) where a plurality of wires connected to the receptacle terminals would extend outwardly from the lower face 8 and be held in place by the strain relief strap 10 as is well known in the art. The connector housing 2 further includes upstanding sidewalls 12 and 14, and an end wall 16. An open end is formed at 18 formed by front edges of the side walls 12 and 14, and a lower surface 19. The side walls 12 and 14 include inside surfaces 20 and 22 which include guide grooves 24. Each groove 24 includes a lead-in portion 26 which communicates with individual grooves 28 and 30. The groove 30 is comprised of a horizontal alignment slot portion 30*a* and a camming slot portion 30*b*. As shown best in FIG. 2, the housing 2 includes mounting flanges 32 having openings 33 therethrough for mounting purposes. Thus, the lead-in openings 24 and the opening 18 are visible form the end, as viewed in FIG. 2. As shown in FIG. 4, the alignment slot portion 30*a* is shown in cross-section as including an undercut slot at 34, thereby forming a T-shaped locking groove.

Figure 5:
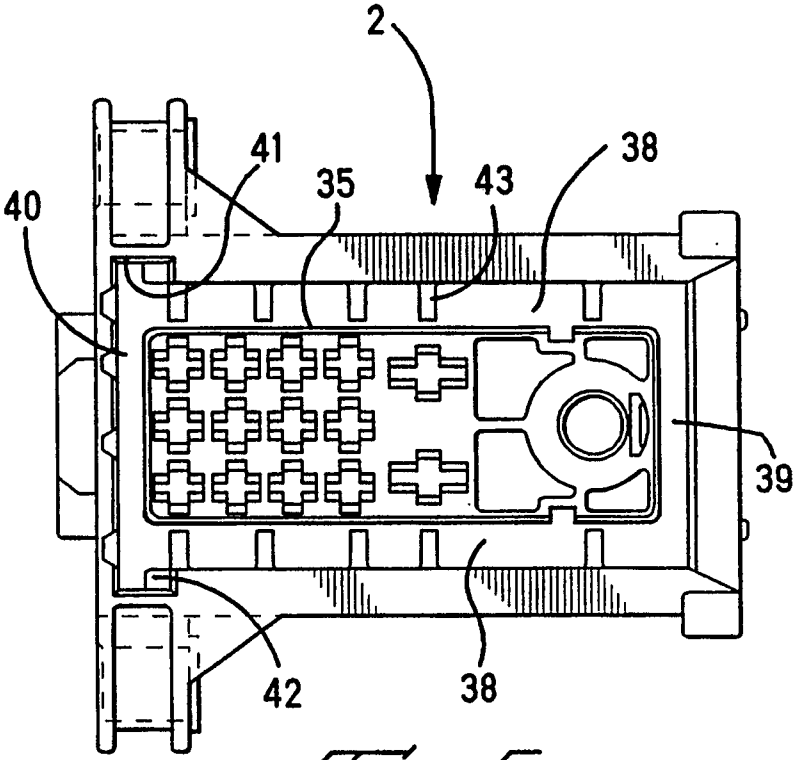
FIG. 5 is a bottom plan view of the connector shown in FIGS. 2–4.

As also shown in FIG. 4, the connector housing 2 includes a central post section 35 having individual through openings 36 for receiving receptacles (not shown) but which will be positioned within the openings 36, below the upper surface 37 of the post section 35. Slots 38 are formed on each side of the post section 35, a forward slot 39 (FIG. 5) is in front of the post section 35, and a rear slot 40 (FIG. 5) is behind the post section 35. Also as viewed in FIGS. 1 and 5, the housing 2 includes slots 41 having a lower shoulder 42, and guiding ribs 43 positioned in the slot 38, as will be described in greater detail herein.

Figure 7:
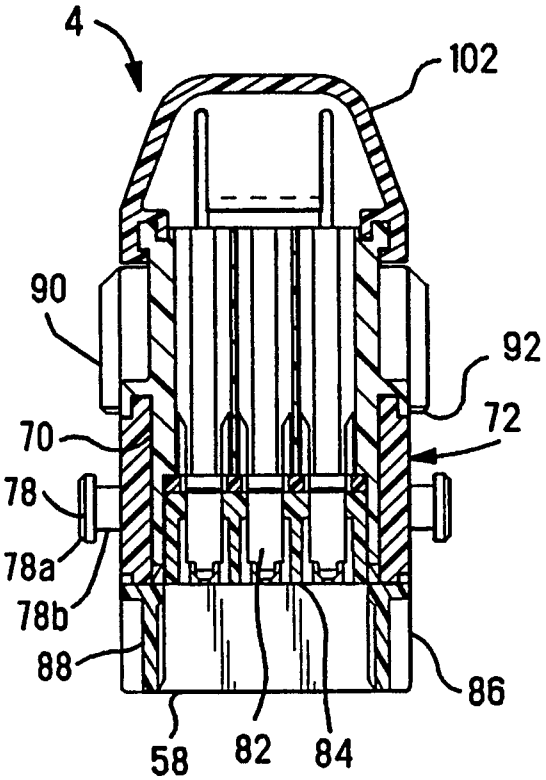
FIG. 7 is a cross-sectional view of the connector of FIG. 6 through lines 7—7.

With reference still to FIG. 1, the housing 4 includes a central body portion 52 having a plurality of terminal receiving apertures 54 for receiving the tab type terminals, and it should be appreciated that the housing body portion 52 would include some members of retaining the tab terminals within the housing body portion, for example some type of locking shoulders. The housing body portion further includes two side walls 56, a mating face 58, a wire exit face 60, a leading face 62 and an outer face 64. Two grooves 70 are integrally formed in the side walls 56 for receiving a camming slide 72, where the camming slide includes slidable arms 74 positioned in the grooves 70, and interconnected by an operating portion 76 which connects the two sliding arms 74 together adjacent to the outer end 64. As shown in FIG. 7, the camming slide 72 and the corresponding slot 70 are tongue-in-groove at upper and lower edges thereof, such that the camming slide 72 is slidable in the track 70, but is axially locked in place. The camming slide 72 further includes two camming spigots 78 and 80 where the spigot 78 is profiled for receipt within the alignment portion 30*a* of the camming slot 30 and the spigot 80 is receivable in the camming slot 28.

The spigots are profiled for locking engagement within the associated camming slots. For example, spigot 78 in FIG. 7 is shown as consisting of a shank portion 78*b* and a head portion 78*a*. Thus when in position, the shank portion 78*b* will be disposed within the slot portions 30*a* or 30*b*, and the head portion 78*a* will be locked within the slot portion 34. This prevents outward bowing or spreading of the sidewalls, preventing disconnection of the two connector members 2 and 4. With reference now to FIG. 7, the connector housing 4 includes a plurality of terminal receiving cavities 82 for receiving tab type contacts where the mating tab portions extend downwardly from a face 84. A shroud 86 surrounds the tab positions which extend from the face 84. The shroud 86 is profiled to fit over the post section 35, which was previously described with reference to FIG. 5. The side walls of the shroud 86 includes thin wall sections 88 which fit between the inclined ribs 43, shown in FIGS. 4 and 5. The housing portion 4 also includes vertically oriented ribs 90 having a lower shoulder 92, which will be described in greater detail herein.

Figure 6:
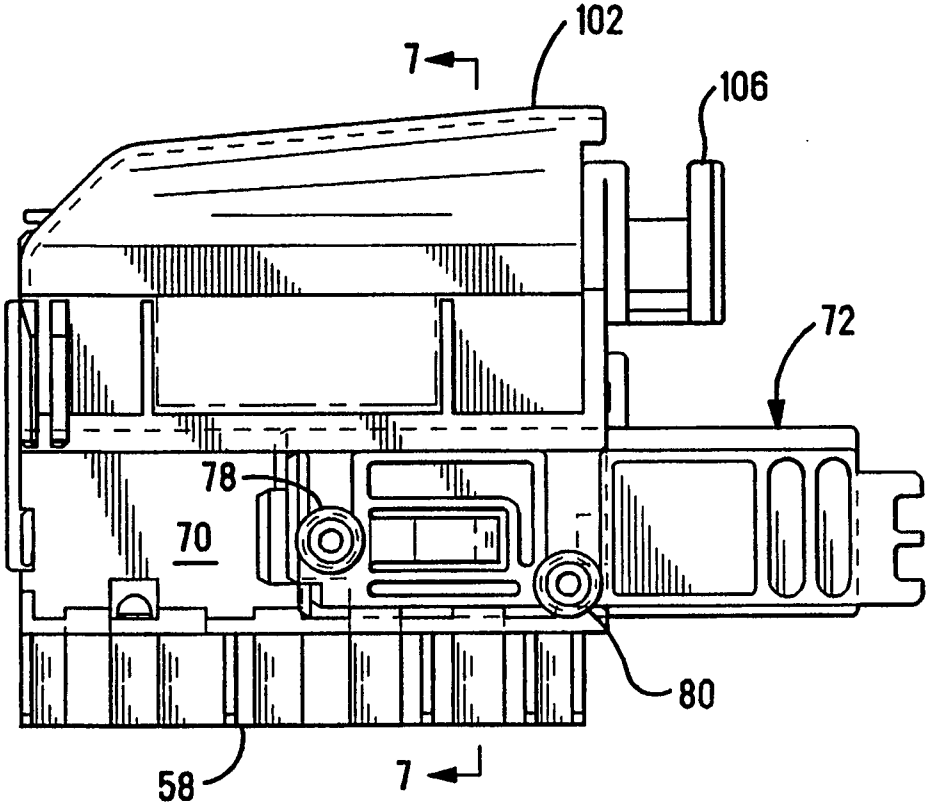
FIG. 6 is a side plan view of the connector carrying the camming slide.

It should be appreciated then that the connector body portion 52 is insertable through the open end portion 18, such that the ribs 90 are positioned through the forward posts 48 of the connector housing 2 with the lower surface portion 92 of the rib 90 positioned on the upper surface 46 of the side walls 12 and 14. Further movement of the connector housing 4 towards the end wall 16 causes the spigots 78 to be positioned within the horizontal portion 30*a* of the guide grooves 30 and positions the spigot 80 at the forward end of the corresponding slot 28. It should be appreciated from FIG. 6 that the forward spigot 78 is vertically higher than the spigot 80 which prevents the possible misalignment of the spigot 78 with the slot 28. It should be appreciated that the housing body portion 52 of the connector housing 4 must be positioned completely rearwardly to a position where the ribs 90 drop into the side slots 41 in the housing side walls 20. The connector housing 4 will be lowered within the connector housing portion 2 by inner movement of the camming slide 72. It should be appreciated that the cooperation between the camming spigot 78 and 80 in their corresponding inclined slots 30*b* and 28 cams the connector housing 4 downwardly such that the two connectors are in mated engagement. When in the fully lowered position, the lower surface 92 of the rib 90 will rest on the corresponding surface 42 in the slot 41.

It should be appreciated that covers 100 and 102 can be positioned on corresponding housings 2 and 4 where the insulated wires can be suitably attached to the corresponding strain relief portions 10 and 106.

Figure 8:
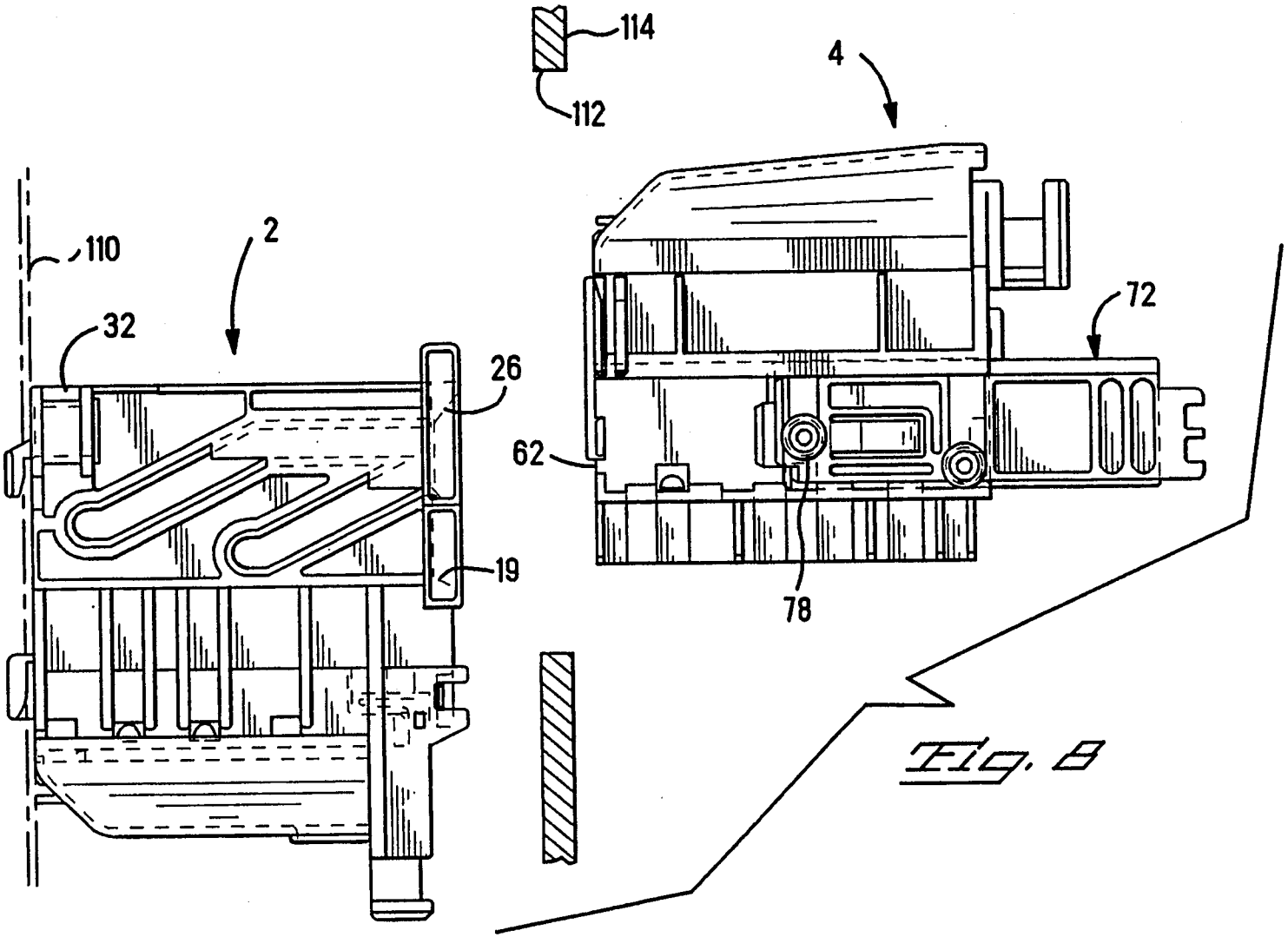
FIG. 8 is a side plan view of the connector mounted, with the mating connector in position to be mated.

Advantageously then, the connector housing portion 2 can be installed to a bulkhead wall such as 110 in FIG. 8 by positioning the flanges against the bulkhead wall 110. The connector housing 2 can be positioned adjacent to an opening 112 in an outer wall 114 where the vertical height of the opening is less than possible with previous designs. Due to the position of the lower surface 19, the connector housing 4 can be moved laterally through the open end of the connector housing 2 as shown in FIG. 8 for mating of the two connector housings. It should also be appreciated that the flared opening 26, as it is positioned at the front edge of the connector housing portion 2 is facing outwardly through the opening 112 and thus is visible for the mating of the connector housing 4.

Figure 9:
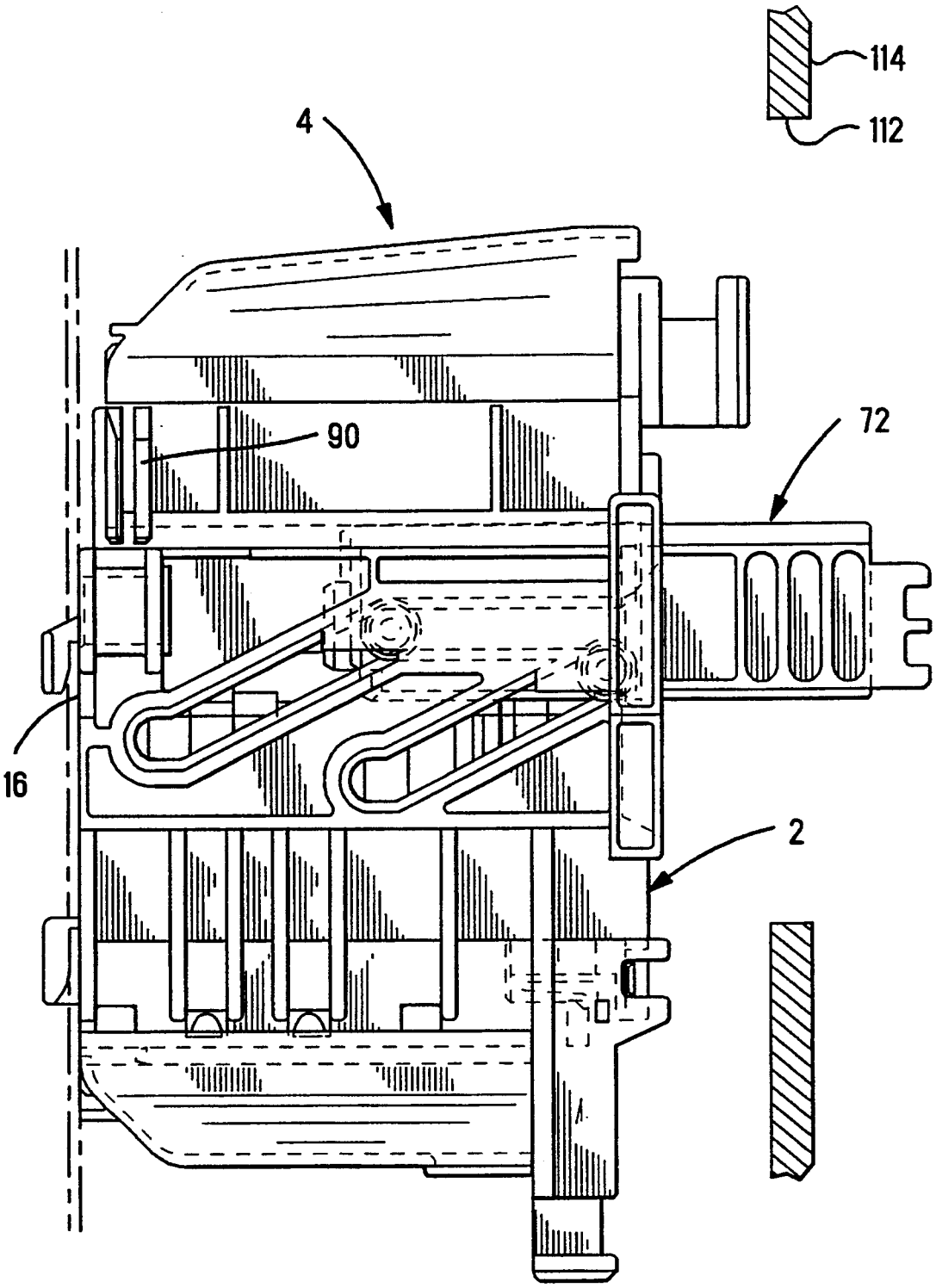
FIG. 9 is a side plan view of the connectors of FIG. 8, showing the mating connector positioned fully forward, but with the camming slide fully retracted.
Figure 10:
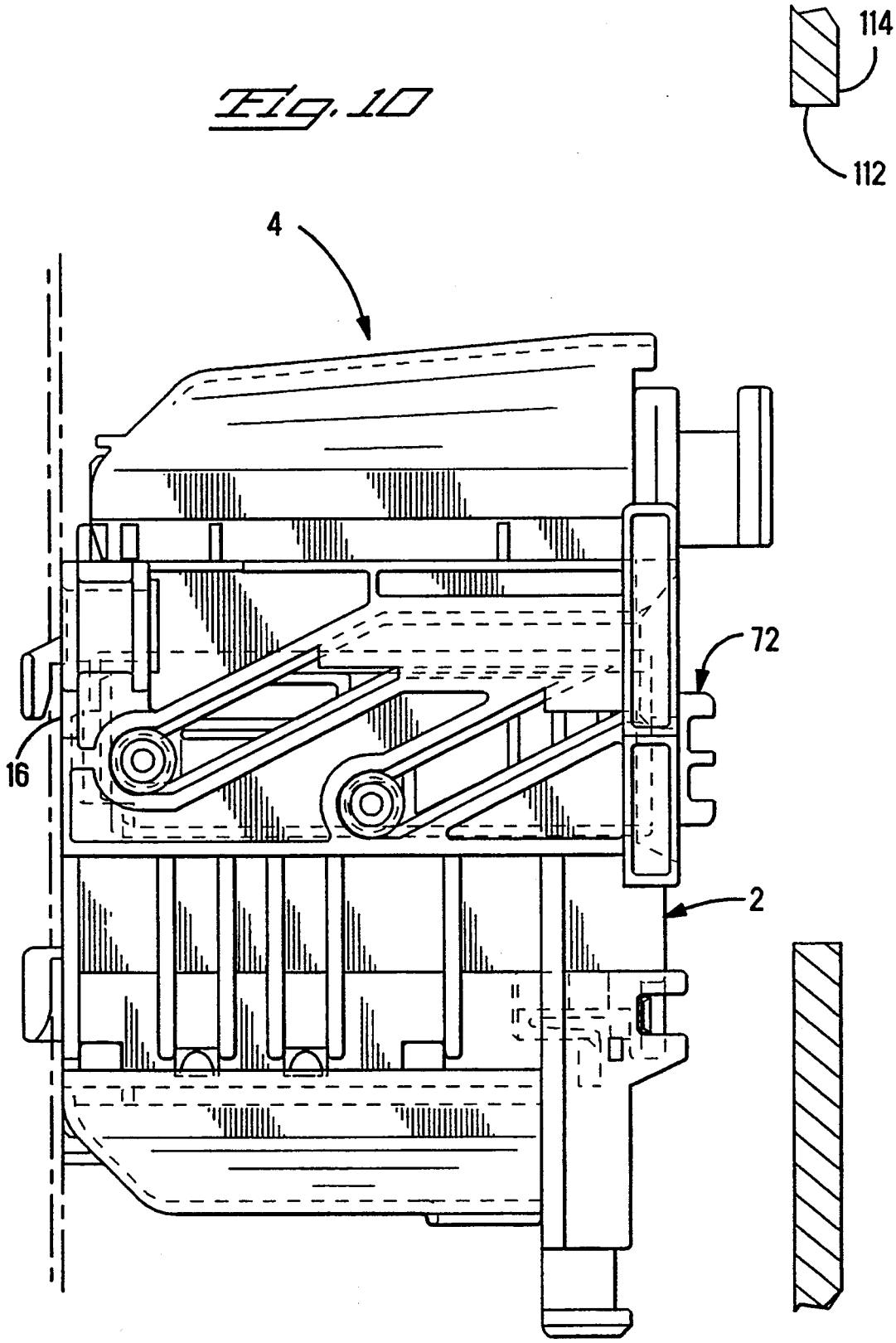
FIG. 10 is a view similar to that of FIG. 9, showing the camming slide fully pushed forward, and the connectors fully mated.

As shown in FIG. 9, the connector housing portion 4 is moved laterally to a position where the connector housing 4 is fully abutted against the corresponding end wall 16 of the connector housing portion 2, and it is in this position where the vertical rib 90 is vertically aligned with its corresponding slot 41. As also shown in FIG. 9, the camming slide is kept in its fully retracted position until the connector housing 4 is fully inserted within the connector housing portion 2. As shown in FIG. 10, the camming slide 72 is moved from its fully retracted position to the fully activated position whereby the corresponding spigots 78 and 80 move the connector axially downward and into corresponding mating engagement with the connector housing 4. It should be appreciated from FIG. 10 that the camming slide 72 extends from the trailing end of the connector housing portion 4. In this manner the installer has full control over the mating and unmating of the connector members 2 and 4 through the opening 112.

I claim:

1. An electrical connector assembly comprising mating first and second connector housings, where one of the housings includes first camming members, and the other connector includes a camming slide moveable transversely to a mating axis, the camming slide including second camming members thereon, which cooperate with the camming members on said first housing, said camming slide being moveable to cause axial movement between said first and second housings along the mating axis, the assembly being characterized in that said first housing has at least one partially opened end wall and said camming members are positioned on inner side surfaces of said first housing, said second connector member being insertable through said partially opened end wall along an axis transverse to said mating axis, and between said side surfaces, whereby activation of said camming slide moves said first and second housings into a mated condition along said mating axis.

2. The assembly of claim 1, characterized in that said inner sidewalls of said first housing include guide grove members parallel to the insertion axis of said second connector.

3. The assembly of claim 2, characterized in that said guide groove members are profiled to receive said second camming members and align them with said first camming members upon full transverse movement of said second housing member.

4. The assembly of claim 2, characterized in said camming members on the camming slide are axially offset and in that said guide groove members are profiled to receive said two axially offset camming members.

5. The assembly of claim 2, characterized in that said second camming members are profiled as camming lugs including head portions adjacent an end thereof, and said guide groove members and first camming member are profiled as T-shaped slots, whereby said camming lugs are locked in place within said guide groove members.

6. An electrical connector assembly comprised of first and second connector housings, wherein said first connector housing includes a peripheral shroud and said second connector is receivable within said shroud, said first and second connectors having complementary contacts being matable along a generally axial direction, the assembly being characterized in that said shroud is comprised of side walls and an end wall leaving one end wall open, said side walls having inner surfaces having guide members thereon, and said second connector has complementary guide members for cooperation with said guide members on said first connector, said second connector being insertable through said open end wall of said first connector, in a direction substantially transverse to said axial direction, under guiding influence of said guide members, said second connector being laterally moveable across a mating face of said first connector housing, to a position where said first and second connectors are axially aligned, whereupon said connector housings can be moved axially, bringing said complementary contacts into mating engagement.

7. The assembly of claim 6, wherein said guide members on said second housing are positioned on a camming slide, whereby actuation of said camming slide causes movement of said first and second connector housings into mated engagement.

8. The assembly of claim 6 wherein said guide members on said first connector housing are guide grooves on inner surfaces of said side walls, at least one of said grooves having a horizontal groove portion extending from said open end inwardly, to a downwardly extending groove portion.

9. The connector assembly of claim 6, characterized in that said first and second connector housings include guide members to ensure proper axial alignment.

10. The connector of claim 6, wherein said guide members on said second housing comprise lugs on an outer surface thereof, which are receivable into said guide grooves.

11. The connector of claim 10, wherein said lugs are positioned on a camming slide which is moveable relative to said second housing.

12. The connector of claim 11, wherein said camming slide is moveable relative to said second housing along the horizontal mating axis of said second connector housing.

* * * * *